United States Patent [19]

Hastings

[11] 4,437,079

[45] Mar. 13, 1984

[54] MAGNETIC SNAP LATCH

[75] Inventor: Jerome K. Hastings, Sussex, Wis.

[73] Assignee: Eaton Corporation, Cleveland, Ohio

[21] Appl. No.: 427,336

[22] Filed: Sep. 29, 1982

[51] Int. Cl.[3] ..... H01H 9/20

[52] U.S. Cl. ..... 335/170; 335/179; 335/183

[58] Field of Search ..... 335/167, 170, 179, 182, 335/183, 184, 155, 255

[56] References Cited

U.S. PATENT DOCUMENTS

| | | | |
|---|---|---|---|
| 1,525,697 | 2/1925 | Stoekle | 335/155 |
| 3,274,525 | 9/1966 | Valleau | 335/255 |
| 3,683,239 | 8/1972 | Sturman | 335/170 X |
| 3,740,682 | 6/1973 | Schantz | 335/170 X |
| 4,000,481 | 12/1976 | Pang | 335/170 |

*Primary Examiner*—George Harris

*Attorney, Agent, or Firm*—W. A. Autio; C. H. Grace

[57] ABSTRACT

A magnetic snap latch having a coil (4) wound on a preformed insulating bobbin (3) having anti-rotation projections (3*a*) that locate and fix the coil within a high permeability magnetic shell (2). A high permeability magnetic plunger (1) extends through a hole (2*a*) in the shell into the coil (4) and has rigidly secured thereto a low permeability magnetic disk (6) within the shell. A high permeability backplate (5) closes the open end of the shell and defines an air gap (AG2) in which is located a non-magnetic return spring (7). When the coil is energized, the disk (6) is initially attracted to the shell (2) to move the plunger (1) a small distance to the right but the disk (6) then saturates and the increasing magnetic force in the air gap (AG2) snaps the plunger (1) to the left, whereafter the return spring (7) restores the plunger (1) when the coil (4) is deenergized.

10 Claims, 5 Drawing Figures

Fig. 3
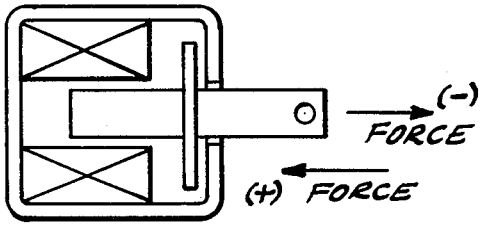
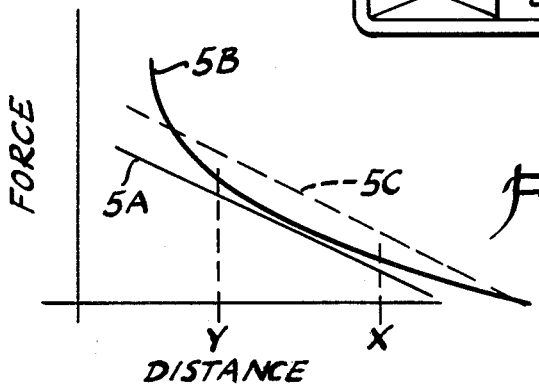
Fig. 5
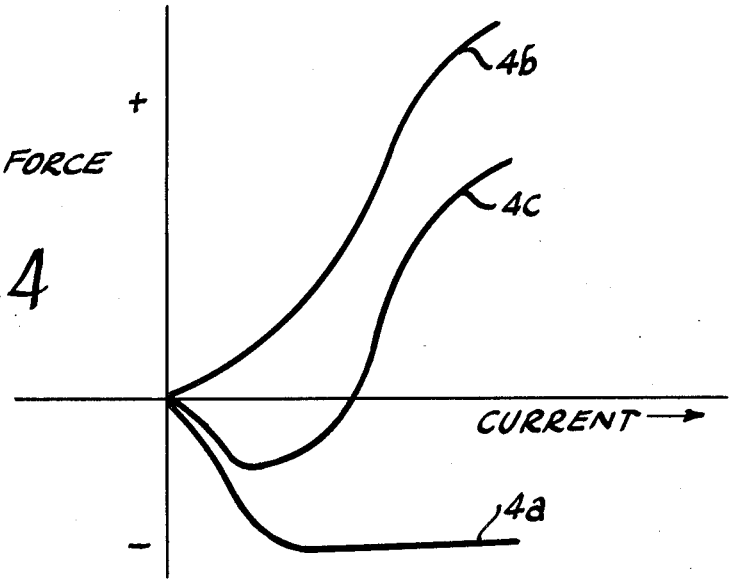
Fig. 4

MAGNETIC SNAP LATCH

BACKGROUND OF THE INVENTION

Magnetic latches have been known heretofore. For example, Pang U.S. Pat. No. 4,000,481, dated Dec. 28, 1976, shows an electrically releasable permanent magnet latch. The armature must be set into its latch position by external means and is then held there by a pair of permanent magnets. Energization of the coil creates a magnetic flux which opposes the permanent magnet flux to permit the operating spring to overcome the armature holding force thereby to allow the spring to operate the armature.

Using magnetic cores that saturate at different current levels of a common winding so as to keep a switch open at high currents and to allow the switch to close at low currents has also been known heretofore. For example, E. R. Stoekle U. S. Pat. No. 1,525,697, dated Feb. 10, 1925, discloses an electromagnet that is especially applicable for use as a lockout switch. This electromagnet has two magnetic circuits such that for currents above a certain predetermined value in the common winding, one core is relatively saturated while the other core is relatively unsaturated so that the pull exerted on the armature by the flux in the unsaturated restraining magnetic circuit exceeds that exerted by the flux in the saturated closing magnetic circuit to keep the contacts open. As the current through the magnetic winding decreases, the flux in both magnetic circuits decreases. However, the flux in the restraining magnetic circuit decreases very much more rapidly than the flux in the closing magnetic circuit. When the current through the magnet winding falls below a predetermined value, the flux in the restraining magnetic circuit has decreased so much that the pull exerted thereby is overcome by the pull exerted by the flux in the closing magnetic circuit and the switch closes.

While these prior devices have been useful for their intended purposes, it has been found desirable to provide an improved snap-acting magnetic latch that is small in size and efficient in operation and is especially applicable to lightweight products.

SUMMARY OF THE INVENTION

An object of the invention is to provide an improved magnetic snap latch.

A more specific object of the invention is to provide a magnetic snap latch that is small in configuration and efficient in operation.

Another specific object of the invention is to provide an improved magnetic snap latch having a minimum number of parts.

Another specific object of the invention is to provide an improved magnetic snap latch that is easy and economical to manufacture and assemble.

Another specific object of the invention is to provide an improved magnetic structure that can be made extremely small in size.

Other objects and advantages of the invention will hereinafter appear.

BRIEF DESCRIPTION OF THE DRAWINGS

FIG. 3 is a schematic illustration of the magnetic snap latch of FIG. 1 showing the directions of the operating forces applied through the plunger thereof.

FIG. 4 is a graph showing force versus current operating characteristics of the magnetic snap latch of FIG. 1.

FIG. 5 is a graph showing force versus distance operating characteristics of the magnetic snap latch of FIG. 1.

DESCRIPTION OF THE PREFERRED EMBODIMENT

Figure 1:
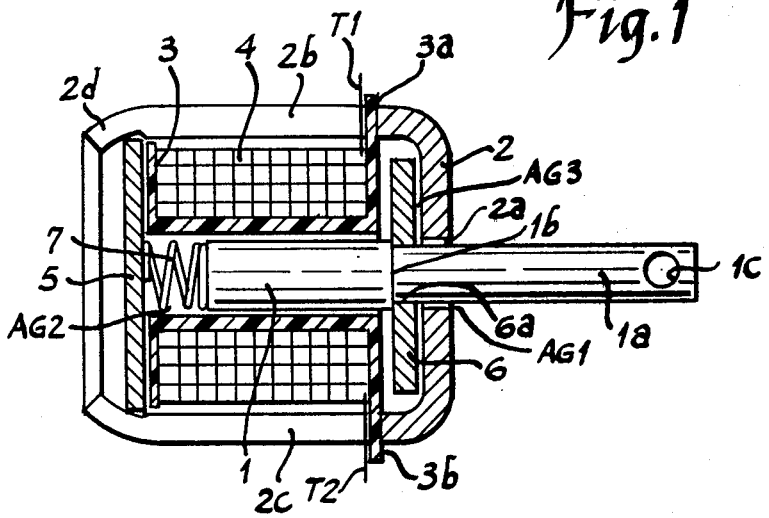
FIG. 1 is a cross-sectional view of a magnetic snap latch constructed in accordance with the invention.

Referring to FIG. 1, there is shown a magnetic snap latch constructed in accordance with the invention. As shown therein, the magnetic snap latch is provided with an armature in the form of a plunger 1 of high permeability magnetizable material such as iron or the like. This plunger 1 extends freely through a hole **2*a* in a cup-shaped, cylindrical high permeability magnetic frame or shell 2. A molded plastic bobbin 3 having a coil 4 wound thereon is mounted within shell 2, this bobbin having suitable projections 3*a*, 3*b* or the like fitting into recesses or slots 2*b* and 2*c* in shell 2 for anti-rotation purposes. Coil terminal wires T1 and T2 extend outwardly of shell 2 through slots 2*b* and 2*c* and are located and protected by projections 3*a* and 3*b*. A high permeability magnetic backplate 5 or the like closes the open end of shell 2 and is secured thereto by crimping the rim 2*d* of the shell over the peripheral edge of plate 5 as shown in FIG. 1. A low magnetic permeability disk 6 is rigidly secured to an intermediate portion of plunger 1 within the bottom portion of cup-shaped shell 2. For this purpose, plunger 1 is provided with a reduced diameter external portion 1*a* that extends through a round hole 6*a* in the middle of disk 6 so that this disk is confined against a shoulder 1*b* of the plunger and secured thereto by suitable means. An helical return spring 7 extends between plate 5 and the internal end of plunger 1**.

Although not shown in FIG. 1, plunger 1 is suitably guided for left and right longitudinal movement so as to remain centered with respect to hole **2*a* in shell 2. For example, it could be guided by the bobbin. In this manner, a first magnetic air gap AG1 is provided between reduced portion 1*a* and the edge of circular hole 2*a* in magnetic frame 2. A second magnetic air gap AG2 is provided between the internal end of plunger 1 and the internal surface of magnetic backplate 5. A third magnetic air gap AG3 is provided between disk 6 and the bottom of shell 2, when the plunger is in its normal unoperated position. A hole 1*c* for receiving a pin or the like may be provided at the external end of plunger 1** for connecting this plunger to an external driven device or mechanism.

While a coil spring 2 has been shown between the inner end of plunger 1 and backplate 5 in FIG. 1, it will be apparent that it is optional in this location and that it could be used in another location or plunger 1 could be returned in the right hand longitudinal direction by other means, for example, restoring means in the driven mechanism.

Also, while a cup-shaped, cylindrical frame 2 has been shown, it will be apparent that it could alternately have other shapes, such as a U-shaped frame, or the like.

Operation of the magnetic snap latch will now be described. When a gradually increasing magnitude of current is applied to coil 4, the current flow produces a magnetic field in the shape of an oval section toroid. The flux path is serially through the plunger, air gap AG2, backplate 5, outside shell 2 and then in parallel paths through air gap AG1 into the plunger and through air gap AG3 and disk 6 into the plunger. Mechanical forces are generated in at least three locations, that is in the main air gap AG2, in the secondary air gap AG1 and in air gap AG3 between shell 2 and threshold disk 6. As the magnetic field builds up, energy is stored in air gaps AG2 and AG1. The magnetic force acts on disk 6 to attract it from its normal position shown in the central schematic in FIG. 2 in the right hand direction toward shell 2 and to move it against the shell to close gap AG3 therebetween as shown by portion A-B of the curve in FIG. 2. In other words, the plunger has moved in the negative direction as shown by the curve in FIG. 2 to a state of reduced or closed gap between disk 6 and shell 2 as shown by the left hand schematic illustration of the latch shown in FIG. 2. The magnetic force on disk 6 rises until its low level of magnetic saturation is reached. This is shown by curve 4*a* in FIG. 4. During this time, a negative force is being applied to the plunger as indicated in FIG. 3. As shown by curve 4*a* in FIG. 4 which represents the negative force on the disk only, the force on the disk levels out at a predetermined point commensurate with the cross-sectional area of disk 6 and the permeability of the material therein.

The functional characteristics are attained by the difference between the high permeability of the flux path including shell 2 and the low permeability of disk 6. Disk 6 saturates before shell 2. This forces the plunger and disk outward up to a predetermined level. Any further increase in flux due to additional coil current has the effect of disk 6 appearing like air. Energy continues to increase in air gap AG2 which provides a positive inward force as shown in FIG. 3 on the plunger directed opposite to the force on the disk. This force on the plunger due to air gap AG2 only is shown by curve 4*b* in FIG. 4. The sum of the forces on the disk and plunger is shown by curve 4*c* in FIG. 4. When the energy in gap AG2 provides a force slightly greater than the force on disk 6, the plunger begins to move in the positive direction as shown by the portion of the curve to the right of point B in FIG. 2. Positive plunger movement forces a gap AG3 to open between disk 6 and shell 2 whereupon the negative force on the disk decays exponentially. Plunger movement yields to the force in gap AG2. This positive force increases exponentially as shown by curve 4*b* in FIG. 4. The plunger force resultant increases at an increasing rate as shown by curve 4*c* in FIG. 4. As a result, plunger 1 moves with a snap action toward the left as shown by portion B-C of the curve in FIG. 2 to a large gap AG3 state as indicated by the right hand schematic of the latch in FIG. 2.

During this time, the magnetic force across gap AG1 is radially and equally balanced. Therefore, the radial forces in this gap AG1 neither contribute nor detract from the plunger movement. The plunger moves completely through its stroke, stopping with an air gap AG2 that is reduced in length as indicated by the right hand schematic of the latch in FIG. 2.

In this state, coil bobbin 3 controls and limits the snap action movement of the plunger. Thus, disk 6 abuts the coil bobbin to limit the plunger stroke. FIG. 5 shows the force versus plunger distance characteristic of the latch. As shown therein, the plunger moves from X to Y in the positive direction. To provide for gradual return of the plunger, as against snap return, a ratio of substantially 1 to 4 is provided between the allowed movement and the magnetic air gap length. This ratio is provided by the length of the gap between disk 6 and coil bobbin 3 compared to the length of air gap AG2. As shown in FIG. 5, if this ratio is kept at 1 to 4 or smaller, the structure will afford gradual return of the plunger when the coil is deenergized because spring force line 5A is tangential to coil force curve 5B so that the coil operates on the substantially straight portion of the exponential coil force curve.

On the other hand, as shown by broken line 5C, if the aforementioned ratio is made larger than 1 to 4 by increasing the relative plunger stroke, the operating point will move higher up coil force curve 5B. Therefore, when the coil is deenergized, the plunger will exhibit a snap-return along line 5C which is undesirable.

Figure 2:
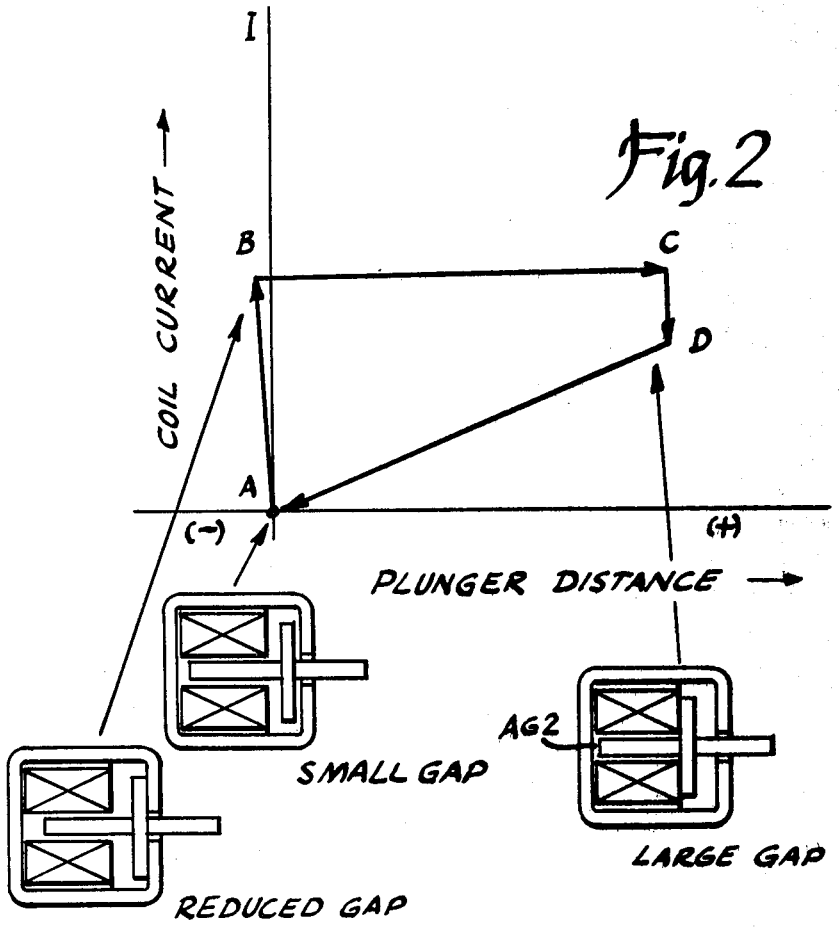
FIG. 2 is a graph showing current versus motion operating characteristics of the magnetic snap latch of FIG. 1.

As the current through the coil gradually decreases, the plunger does not start to return immediately because there is an excess of coil current that overpowers the return spring 7 as indicated by portion C-D of the curve in FIG. 2. When the coil current decreases further, the plunger will move out to its original position under the force of return spring 7 as indicated by portion D-A of the curve in FIG. 2. While portion D-A of this curve is shown as a straight line for ease of illustration, it will be apparent that its particular form will be dependent on the characteristics of the spring and the material in the magnetic circuit.

From the foregoing, it will be apparent that the action is rapid snap motion of the plunger in the left hand or inward direction as a result of a gradual increase in coil current and return motion of the plunger in the opposite or right hand direction to its normal position as a result of a gradual decrease in coil current. It will be apparent from the foregoing description that the invention converts a gradually increasing signal, such as from a thermocouple or the like, to a discrete open/closed mechanical function. It provides a calibration-adjustment-free latch mechanism since calibration is dependent on the permeability of the material and this parameter is metallurgically controlled and very dependable. The snap movement provides a "fixed force" capability to overcome friction and return spring forces. Return of the plunger provides the earliest possible reset response time which response time can be set by the selection of the return spring force. The invention disclosed provides miniaturization of typically complex latches in that it could be made very, very small, even as small in diameter as an ordinary pencil. It has simplicity of design with a minimum number of parts and improved vibration performance. It provides increased immunity to false tripping at the critical 115 percent overload point which is attained by the outward force on the disk. It has a universal trip device design in that higher current requirements use fewer turns on the coil and lower current requirements use more turns on the coil. It has built-in anti-rotation means in that the coil bobbin is provided with extending fingers that not only engage in slots in the shell to locate and lock the bobbin in place but also protect and locate the coil terminal wires. The construction disclosed has no fasteners, adhesives or pins to hold the assembly together because all parts are self-locating and are fixed by the rolled edge of the shell which is rolled over the backplate. The latch construction provides flexibility in its shape in that the function can be accomplished by a long and thin configuration as well as a short and wide configuration and it is adaptable to many construction constraints. The disclosed latch structure will be stable over a wide temperature range since the stability of the trip point depends upon the saturation of the material in disk 6.

While the apparatus hereintofore described is effectively adapted to fulfill the objects stated, it is to be understood that the invention is not intended to be confined to the particular preferred embodiment of magnetic snap latch disclosed, inasmuch as it is susceptible of various modifications without departing from the scope of the appended claims.

I claim:

1. A magnetic snap latch comprising:

a magnetic circuit comprising a magnetic frame;

a magnetic plunger extending into said frame and having an internal end therewithin and an external end adapted to be coupled to a driven element;

said magnetic circuit also comprising means defining an air gap between said internal end of said plunger;

said magnetic circuit when said plunger is in its normal position;

and means normally maintaining said plunger in its normal position whereby said air gap is open;

a coil having terminal wires extending therefrom and means mounting said coil within said frame to surround said internal end of said plunger;

a low permeability magnetic member secured to an intermediate point of said plunger for magnetic attraction to said frame upon initial energization of said coil to restrain said plunger from being moved by the magnetic force in said air gap;

and said low permeability magnetic member reaching magnetic saturation before said magnetic frame whereby the magnetic force in said air gap causes snap action movement of said plunger in the closing direction of said air gap.

2. The magnetic snap latch claimed in claim 1, wherein:

said means mounting said coil comprises:

a preformed bobbin on which said coil is wound;

means on said bobbin for locating it within said magnetic frame to prevent its rotation therein and to locate and protect said terminal wires extending from said coil.

3. The magnetic snap latch claimed in claim 1, wherein:

said low permeability magnetic member is a disk having a central hole through which said plunger extends;

and said plunger has a reduced cross section extending in one direction from said intermediate point providing a shoulder against which said magnetic disk is secured.

4. The magnetic snap latch claimed in claim 1, wherein:

said means normally maintaining said plunger at open air gap is a plunger return spring.

5. The magnetic snap latch claimed in claim 4, wherein:

said plunger return spring is an helical spring of nonmagnetic material in said air gap between said internal end of said plunger and said means in said magnetic circuit defining said air gap.

6. The magnetic snap latch claimed in claim 1, wherein:

said magnetic frame comprises a cup-shaped, cylindrical magnetic shell having a hole in its bottom through which said plunger extends freely thereinto;

and said means mounting said coil comprises slots in the sides of said magnetic shell locating and retaining said coil therewithin.

7. The magnetic snap latch claimed in claim 6, wherein:

said means defining an air gap between said internal end of said plunger and said magnetic circuit comprises:

a magnetic backplate secured within the open end of said cup-shaped, cylindrical magnetic shell.

8. The magnetic snap latch claimed in claim 6, wherein:

said magnetic shell and said backplate and said plunger have a higher magnetic permeability than said low permeability magnetic member secured to said plunger.

9. The magnetic snap latch claimed in claim 1, wherein:

said plunger comprises means at its external end for attaching the same to a driven device.

10. The magnetic latch claimed in claim 1, wherein:

said magnetic latch also comprises means limiting the maximum distance of said snap action plunger movement;

and said maximum distance of plunger movement having a predetermined ratio to the length of said air gap such that said latch operates on the substantially straight portion of the coil force versus plunger distance operating characteristic thereby to afford gradual return of the plunger when said coil is deenergized.

* * * * *